US011692399B2

(12) United States Patent
Graß et al.

(10) Patent No.: US 11,692,399 B2
(45) Date of Patent: Jul. 4, 2023

(54) CONTROLLABLE DRILLING HEAD

(71) Applicant: TRACTO-TECHNIK GmbH & Co. KG., Lennestadt (DE)

(72) Inventors: Peter Graß, Lennestadt (DE); Christian Loher, Eslohe (DE)

(73) Assignee: Tracto-Technik GmbH & Co. KG, Lennenstadt (DE)

( * ) Notice: Subject to any disclaimer, the term of this patent is extended or adjusted under 35 U.S.C. 154(b) by 0 days.

(21) Appl. No.: 17/467,173

(22) Filed: Sep. 3, 2021

(65) Prior Publication Data

US 2022/0098931 A1 Mar. 31, 2022

(30) Foreign Application Priority Data

Sep. 30, 2020 (DE) ..... 102020005980.5

(51) Int. Cl.
*E21B 7/06* (2006.01)
*E21B 7/04* (2006.01)
*E21B 19/086* (2006.01)

(52) U.S. Cl.
CPC ..... *E21B 7/067* (2013.01); *E21B 7/046* (2013.01); *E21B 19/086* (2013.01)

(58) Field of Classification Search
CPC ..... E21B 7/067; E21B 7/046; E21B 19/086
See application file for complete search history.

(56) References Cited

U.S. PATENT DOCUMENTS

| | | | | |
|---|---|---|---|---|
| 5,597,046 | A | 1/1997 | Fisk | |
| 6,012,536 | A * | 1/2000 | Puttmann | E21B 7/068 175/21 |
| 2004/0040748 | A1 | 3/2004 | Puttmann | |
| 2005/0236187 | A1 * | 10/2005 | Chen | E21B 10/26 175/75 |

FOREIGN PATENT DOCUMENTS

| | | |
|---|---|---|
| DE | 19947645 C1 | 3/2001 |
| DE | 69329551 T2 | 3/2001 |
| DE | 10052574 A1 | 5/2002 |

* cited by examiner

*Primary Examiner* — Dany E Akakpo
(74) *Attorney, Agent, or Firm* — Leason Ellis LLP

(57) ABSTRACT

A controllable drilling head for a drill string for ground drilling with a drilling head tip and a locating pin that carries the drilling head tip, the drilling head tip having a bore slanted to the longitudinal axis and the locating pin being angled to the longitudinal axis, wherein the drilling head tip can rotate on the locating pin, the drilling head tip and the locating pin being arranged in a first angular position relative to one another for straight drilling, and the drilling head tip and the locating pin being arranged in a second angular position relative to one another for drilling that deviates from straight drilling.

6 Claims, 2 Drawing Sheets

CONTROLLABLE DRILLING HEAD

FIELD OF INVENTION

The invention relates to a controllable drilling head for a drill string for ground drilling, a ground drilling device, and a method for controlling a drilling head on a drill string for ground drilling.

BACKGROUND

There is fundamentally a need in ground drilling to direct the drill string located in the ground to a specific target or to move it along a desired path. In horizontal drilling in particular, which sometimes occurs in densely built-up areas with extensive infrastructure, particularly underground, the accuracy of the drill string plays a major role. The drill string must be able to reach an often narrowly delimited end pit with accuracy in order to bring an earth passage, a pipe, or a cable to a desired position or to be able to get the drill string to emerge from the surface at a certain point.

For ground drilling devices in which the drill string is pushed into the soil, it is known to use a permanently asymmetrical driving head (for example, one that is slanted) for a constant steering movement during advancement. For straight travel, the entire drill string or the driving head is rotated, leading to a drilling motion of the ground drilling device that is tumbling but essentially straight ahead. In order to maintain the rotation of the driving head or the drill string, a mechanical device is usually provided, which is located outside the borehole and effects the sustained rotation. The permanently asymmetrical driving head and the sustained rotation thereof do enable control of the drill string, but there are considerable design engineering and machinery requirements, because in addition to the drive for advancing the drill string in the pushing direction, a drive for the rotation as well as appropriate elements for transmitting the rotational force must be available.

SUMMARY

Proceeding from the prior art, the invention was based on the object of creating, for soil drilling operations that use a drill rod, a controllable drilling head, a ground drilling device, and a method for controlling a drilling head on a drill string for ground drilling, the object being economical and easily constructed, managed, and designed.

This object is achieved by the subject matter of the independent claims. Advantageous embodiments are the subject matter of the respective dependent claims and/or result from the following description.

The invention is based on the idea of using a controllable drilling head with a drilling head tip that does not have to constantly move to run straight ahead. Instead, in addition to eliminating constant movement of the drilling head tip, a simple design is enabled, in which the drilling head tip has a bore angled to the longitudinal axis, which is designed to receive a locating pin. The drilling head tip sits on the locating pin, which is also angled with respect to its longitudinal axis. The drilling head tip and the locating pin can be rotated relative to one another. It is intended that the angled components can compensate for one another in a first angular position in such a way that the drilling head tip can run straight ahead. In a second angular position between the drilling head tip and locating pin, the angles can add up, in particular completely, so that the drilling head tip can assume an angled position to the longitudinal axis of the drill string, which in particular can correspond to the sum of the angles. This enables course correction by means of the drilling head tip, which can be rotated relative to the locating pin. There is no need to constantly turn an outwardly asymmetrical drilling head tip. Asymmetry is "relocated" to the inside of the drilling head tip in the form of a bend in a bore or in the form of a bore slanted to the longitudinal axis. Since in particular (only) two angular positions of the drilling head tip relative to the locating pin can exist, the first angular position can be used for straight drilling, and the second angular position can be used for course correction. Since the locating pin does not require constant movement for straight travel, the turning of the locating pin for course correction, in particular manually, can be carried out over just a short period of time. In particular, a marking can be provided on the outer circumference of the drill rods and/or drive to indicate the angular position of the rod and thus the relative position of the drilling head tip to the locating pin. A complex rotary drive with a high drive power requirement is not required. The user can benefit from the fact that efficient control is also possible for a ground drilling device that is small and/or of simple design.

The invention provides a controllable drilling head for a drill string for ground drilling with a drilling head tip and a locating pin that carries the drilling head tip. The drilling head tip has a bore running slanted to the longitudinal axis. The locating pin is angled to the longitudinal axis. The drilling head tip can be rotated on the locating pin, so the drilling head tip and the locating pin are designed to be able to be rotated relative to one another. For straight drilling, the drilling head tip and the locating pin can be arranged in a first angular position relative to one another. For drilling that deviates from straight drilling, the drilling head tip and the locating pin can be arranged in a second angular position relative to one another.

In the context of the description, the term "drill string" denotes a string having a drilling head and a rod, which can be moved by means of a ground drilling device or a driving device in order to create an earth borehole through the soil.

In the context of the description, the term "rods" is not limited to rigid rods with individual rod sections directly or indirectly connected to one another that can be used with a ground drilling device. In a preferred embodiment, the rod sections are designed to be rigid. To connect the rod sections to one another and to form the drill string, a plug connection of the individual drill string members is preferably provided. A rotationally fixed connection of the rod sections or drill string members is preferred.

The term "rod section" in the context of the description denotes an element that extends along a longitudinal axis and that is part of the rod or the drill string for ground drilling. The rod section can be designed as an element at the front of the drill string with an assigned function (e.g., a transmission housing), or it can be designed as an element that extends the drill string (only mechanically) as a rod section. The rod section can comprise mechanical channels for, for example, drilling fluid, electrical conductors, electrical components, and/or electronic components.

A rod section in the context of the description can have an outer diameter of 25 mm to 65 mm, preferably 30 mm to 60 mm, preferably 35 mm to 55 mm, preferably 40 mm to 50 mm. A rod section in the context of the description can have a total length of 450 mm to 650 mm, preferably 500 mm to 600 mm, preferably 520 mm to 580 mm. A rod section in the context of the description can have an effective length that takes into account in particular the length of the connecting elements, in particular the connecting elements provided at the end, for example a length of the connecting socket and/or the connecting plug in the case of a plug connection. The effective length can result from the total length minus the length of the connecting element or elements and can be 400 mm to 600 mm, preferably 450 mm to 550 mm, preferably 475 mm to 525 mm. A rod section in the context of the description can have a groove for engaging an engaging element for moving the drill string, for example a (locking) pawl, which can have an outer diameter of 15 mm to 55 mm, preferably 20 mm to 50 mm, preferably 25 mm to 45 mm, preferably 30 mm to 40 mm. In a particularly preferred embodiment, the total length of the rod section can be 550 mm and the outer diameter of the rod section 45 mm. The effective length of a rod section can be 500 mm. The outer diameter of a groove for engaging an engaging element for moving the drill string can have an outer diameter of 35 mm. The stated values for the outer diameter of the rod section, the (total) length of the rod section, the effective length of the rod section, and the outer diameter of a groove on the rod section are not values that restrict the dimensions. It is to be emphasized that an adaptation to the external conditions, in particular the size of the excavation pit or the shaft for the arrangement of the ground drilling device and/or the nature of the soil, can occur to carry out an earth borehole efficiently.

In particular, a rod section and/or the drilling head in the context of the description can be configured at the end to form at least one plug connection. At one end, the rod section and/or the drilling head can have (a) a connecting plug with an outer contour or (b) a connecting socket with an inner contour. The outer contour or the inner contour can have a cross section deviating from a circle in shape.

If it is described that a connecting plug or a connecting socket is provided at one end of the rod section, it can be stipulated that a connecting plug is present at one end and a connecting socket at the other end of that same rod section. It is possible to form a plug connection at both ends of one and the same rod section, the outer contour or the inner contour having a cross section deviating from a circle in shape. However, it is also possible that a rod section according to the invention has a previously described connecting plug with an outer contour or a previously described connecting socket with an inner contour at only one end, with the other end being able to be designed as desired. An embodiment of a rod section in which only one end has a connecting plug or a connecting socket with a contour as described enables an embodiment for which it is possible to switch to a different connection system.

The term "cross section" in the context of the description denotes a section slanted to the longitudinal axis of a given element in the area of the plug connection, that is, for the rod section or the drive element in the end region of the rod section or the drive element that is used for the connection with the element to be connected. The cross section is preferably regarded as an angle of 90° to the longitudinal axis. Slight deviations from the right angle to the longitudinal axis are possible.

A rod section in the context of the description can have a connecting plug at one end and a connecting socket at the other end. This enables a simple connection to be established when the rod sections are in a certain orientation. The inner contour and the outer contour of the connecting socket or the connecting plug can be aligned with one another in a predetermined angular position, so that the respective contours at the two ends of the rod sections are aligned with one another or are aligned such that they can be plugged into one another. However, it can also be provided that the rod section has plug elements of the same form at the ends, so that the rod section has, for example, a connecting plug at both ends or a connecting socket at both ends, which can have the respective contour described.

In the context of the description, a "shape deviating from a circle" is any geometric shape that does not have a circular shape. The shape that deviates from a circle thus does not have only points of a plane (the cross section that is being considered) that are equidistant from a given point of this plane (midpoint). There is the possibility that the shape deviating from a circle has straight lines at least in sections. The shape can additionally or alternatively have bent or curved lines. As described below, the shape deviating from a circle can also have a familiar configuration that is readily identifiable.

The shape deviating from a circle can be an oval, in particular a rounded, convex figure, wherein the figure can be an ellipse as a special case. The shape deviating from a circle can be an ellipsoidal shape. In the context of the description, an ellipse is understood to denote a closed oval curve that can be represented by a conic section. Generally, an ellipse is a shape with points for which the sum of the distances between a point and two specified points, known as the focal points, is the same for all points. Generally, the straight line through the focal points of the ellipse is designated as the major axis, and the straight line orthogonal thereto through the midpoint of the ellipse is designated as the minor axis.

It can be provided that the shape, particularly an oval, which is designed in particular as an ellipse, is designed in such a way that the shape has no symmetry, whereby it can be achieved that the connecting plug and connecting socket can only be plugged together at an angular position relative to one another.

The term "ground drilling device" in the context of the description comprises any device that can move in particular a drill string having rod sections in an existing passage in the soil or in one to be created in order to create or widen a borehole, in particular a horizontal drill hole, or to pull pipelines or other long bodies into the soil. The ground drilling device can be in an excavation pit or a shaft, in particular a channel shaft. In particular, the ground drilling device can be designed for introduction of the drill string into the soil by pushing or pressing. An additional pulling mode of operation can be provided, in which the drill string and/or a pipe can be pulled into the soil after the pushing introduction, in particular as far as a target pit.

The term "horizontal drilling" in the context of the description comprises in particular any type of passage in a body, existing or to be created, preferably horizontal, particularly earth passages including earth boreholes, rock boreholes, or earth conduits as well as underground or above-ground pipelines and water channels, that can be widened or pulled in by using an appropriate ground drilling device.

The term "locating pin" denotes a body that is at least partially pin-shaped that is present in particular at the end of the body and onto which another body, in particular the drilling head tip, can be inserted. The locating pin can be arranged essentially centrally in relation to the cross section. The bend of the locating pin can extend from the central position at a predetermined bend angle.

In the context of the description, the term "drilling head tip" denotes a body that is the front end of the drill string. The drilling head tip can be considered the first element of the drill string. The drilling head tip can be exposed and, as the first member of the drill string, contact the soil first when the earth borehole is introduced in a pushing manner. The drilling head tip can have an outer contour that can be completely symmetrical. The outer circumference and the shape of the drilling head tip can have not only mirror symmetry with respect to a cut through a centerline, but in particular have point symmetry. This allows the basic idea of the invention to be implemented in a simple manner. An outwardly existing symmetry, which requires constant rotation, is preferably not present.

If it is described that the drilling head tip can be rotated in relation to the locating pin, direct placement of the drilling head tip on the locating pin can be preferred. However, it can also be stipulated that an intermediate element is provided between the locating pin and the drilling head tip for an indirect connection.

In a preferred embodiment, the axis of a section of the bore in the drilling head tip, into which in particular the locating pin can be inserted, forms an angle with the longitudinal axis of the drilling head tip of 1° to 20°, preferably 2° to 15°, preferably 3° to 13°, preferably 3° to 10°, preferably 4° to 10°, preferably 4° to 8°. In a particularly preferred embodiment, there is an angle of 5° from a section of the bore to the longitudinal axis of the drilling head tip. In particular, it can be stipulated that the bore extends from a central opening in the drilling head tip at the aforementioned angle in the drilling head tip.

In a preferred embodiment, the bend of the locating pin forms an angle of 1° to 20° with the longitudinal axis of the locating pin. The bend of the locating pin can preferably be at an angle of 2° to 15°, more preferably 3° to 13°, more preferably 3° to 10°, more preferably 4° to 10°, more preferably 4° to 8°, to the longitudinal axis of the locating pin. In a particularly preferred embodiment, the bend of the locating pin forms an angle of 5° with the longitudinal axis of the locating pin. Setting an angle allows for the magnitude of the "course correction" to be specifically referenced and for the selection of an angle suitable for a borehole.

In a preferred embodiment, the drilling head tip has a diameter of less than 70 mm, preferably less than 65 mm, preferably less than 60 mm. In a particularly preferred embodiment, the drilling head tip has an outer diameter of 55 mm. Appropriate diameters can be elected for smaller operations (i.e., for creation of shorter or thinner earth boreholes). Alternatively or in addition, the drilling head tip can be adapted to the size of the ground drilling device and/or the nature of the soil into which the earth borehole is to be created. In addition to an adaptation of an outer diameter, the geometry of the drilling head tip can be adapted to the nature of the soil or the material surrounding the borehole.

In a preferred embodiment, the locating pin is at least partially surrounded by a wear sleeve so that a holding fixture for the locating pin, in particular at the end, lies in the area of the longitudinal axis that is congruent with the drill string when the drilling head is part of the drill string. All that is required is to replace the wear sleeve when the drill string has been used many times. The added cost of the manufacture of the locating pin can be suppressed by providing the wear sleeve. The wear sleeve can be part of an adapter for integrating the controllable drilling head on the front of a drill string. The adapter can have, on its end opposite the locating pin, a connecting section for attaching it to a rod section of a drill string. The locating pin can be fixed in the adapter in the wear sleeve by means of a transverse pin such that rotational, pulling, and pushing movement are prevented.

In a preferred embodiment, the outer circumference of the locating pin, which can come into contact with the inner contour of the bore of the drilling head tip, or the inner contour of the bore of the drilling head tip, which can come into contact with the outer contour of the locating pin, is delimited by or has two stop surfaces. The two stop surfaces are spaced apart from one another in the longitudinal direction of the drilling head tip or of the locating pin. In each of the two angular positions, one of the stop surfaces of the drilling head tip can rest against a stop surface of the locating pin. The stop surfaces can form end positions of a relative rotational movement of the locating pin in the bore. This allows for setting two specific angular positions of the drilling head tip relative to the locating pin. The angular positions can be set precisely, and the deflection of the drilling head tip relative to the drill string can be used to precisely control the drilling head.

In a preferred embodiment, the two stop surfaces are designed with respect to one another in such a way that an angle of rotation of greater than 45° between the drilling head tip and the locating pin can lead to a transition from the first angular position to the second angular position. In this way, it can be achieved that the two angular positions can be deliberately set from one another and that a necessary rotation between the two angular positions is sufficiently large to allow for deliberate actuation of one of the two angular positions. The angle between the two stop surfaces can preferably be >50°, more preferably >60°, more preferably >70°, more preferably >80°, more preferably >90°, more preferably >100°, more preferably >110°, more preferably >120°, more preferably >130°, more preferably >140°, more preferably >150°, more preferably >160°, more preferably >170°, in particular 180°. In a particularly preferred embodiment, the two stop surfaces are parallel to one another.

The invention also provides a ground drilling device with a controllable drilling head as described and a drive that can be located in an excavation pit, by means of which a drill string with the drilling head can be driven in a pushing or pulling manner, particularly in a pushing manner.

In a preferred embodiment, an engagement for a tool for rotating the rod section about its longitudinal direction is provided at the end of a rod section of the drill string. In this way, a simple embodiment can be achieved in which the drill string can be rotated about its longitudinal axis in order to rotate the locating pin. The locating pin can be rotated relative to the drilling head tip, and a corresponding angular position can be set.

In a preferred embodiment, a scale is formed in the area of the drive, by means of which a degree of rotation of the stop surfaces about the longitudinal axis of the locating pin or the bore can be displayed. The scale can correspond to a marking on the rod sections.

The invention also provides a method of controlling a drilling head on a drill string for ground drilling. The drilling head has a drilling head tip and a locating pin that carries the drilling head tip. The drilling head tip has a bore running slanted to the longitudinal axis, and the locating pin is angled to the longitudinal axis. The drilling head tip and the locating pin are designed to be able to be rotated relative to one another. For straight drilling, the drilling head tip and the locating pin can be set to a first angular position relative to one another. For drilling that deviates from straight drilling, the drilling head tip and the locating pin can be set to a second angular position relative to one another.

Explanations of the individual aspects of the invention, as they are described in particular for the controllable drilling head and the method, are to be understood as explanations that complement one another. Explanations of one aspect also apply to the explanations of one of the other aspects.

Numerical values in the context of the description are values that can be subject to a tolerance in particular of +/−10%, so the numerical values do not specify only the one value, but rather constitute a range of values, particularly to account for tolerance ranges that could result from the manufacturing process.

Neither the above statements of nor the following description of exemplary embodiments constitute a waiver of any particular embodiments or features.

BRIEF DESCRIPTION OF THE DRAWINGS

The invention is clarified below with reference to the exemplary embodiment shown in the figures.

The figures show.

DETAILED DESCRIPTION

Figure 1:
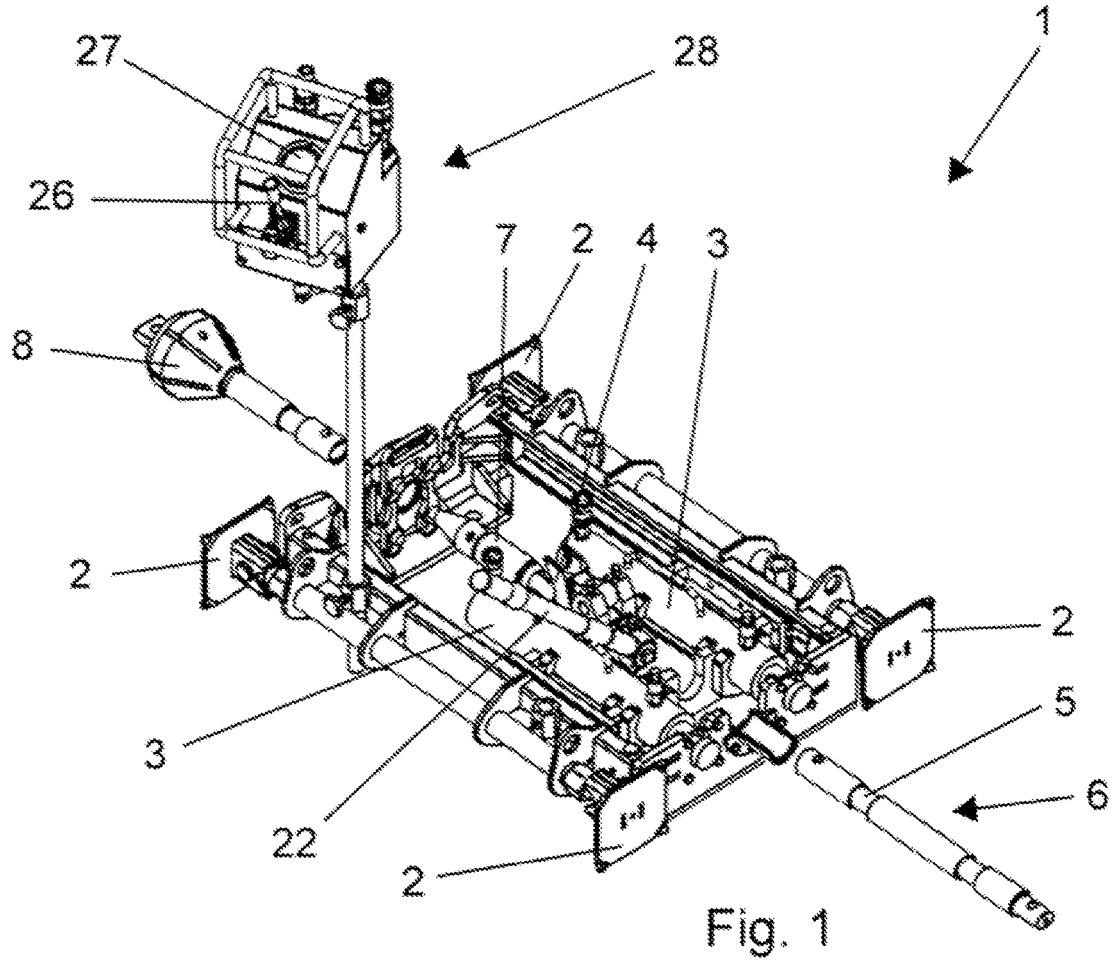
FIG. 1 a ground drilling device with parts of a drill string in an isometric view.

FIG. 1 shows a ground drilling device 1, which can be braced by means of supports 2 arranged on the frame in an excavation pit (not shown).

A drill string can be pushed or pulled into the ground by using an engaging element embodied as a locking pawl 4, which is fastened to a slide 50 that can move forward and backward relative to the frame. The locking pawl 4 engages in one of the grooves 5 of a rod section 6. The hydraulic cylinder 3 is acted upon, moving the locking pawl 4 accordingly, so that the drill string can be pushed into the ground. During the return stroke of the hydraulic cylinder 3, the locking pawl 4 tilts out of a groove 5 to fall into the next groove 5 when it is reached. Another feed cycle can then be initiated.

The application of the hydraulic cylinder 3 can be controlled from a control panel 28. The control panel 28 has a pressure display 27 to provide pressure information or to set pressure by means of a hydraulic valve 26.

Figure 2:
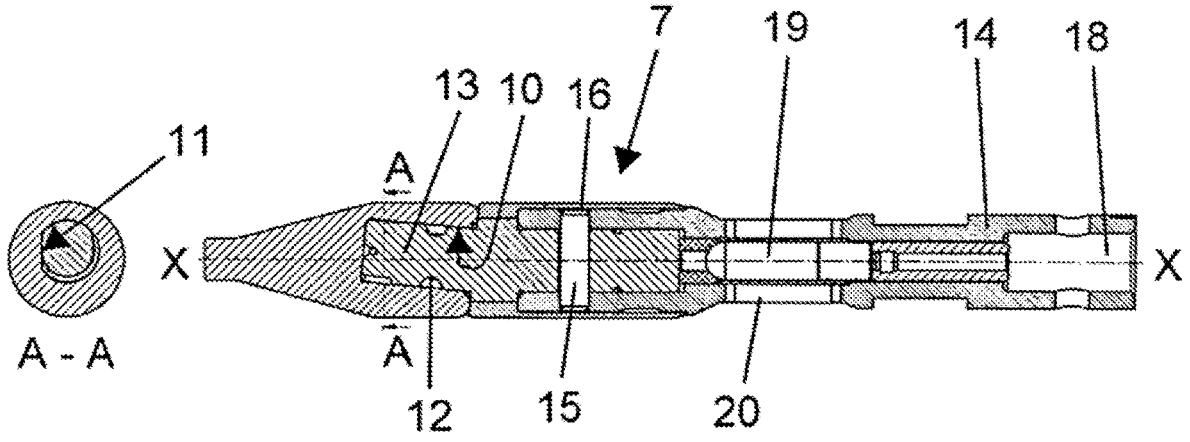
FIG. 2 a section through a front area of a drill string with a drilling head in a first angular position.

FIG. 2 shows a section through a drilling head 7, by means of which the direction of the drill string can be controlled. The drilling head 7 is shown here in a state in which a straight introduction of the drill string can take place. The outer contour of a drilling head tip 9 at the front of the drilling head 7 forms an extension of the drill string. There is no angle between the drilling head tip 9 of the drilling head 7 and the longitudinal axis of the drill string.

The drilling head tip 9 of the drilling head 7 has a bore 10 at an angle of 5° relative to the longitudinal axis X-X, which is not round over the entire circumference in a partial area of its length. By means of the bore 10, the drilling head tip 9 can be inserted onto a locating pin 13, mounted such that it can be rotated relative to the locating pin 13. The locating pin 13 can be rotated relative to the drilling head tip 9. By means of retaining pins (not shown), which can engage with a recess 12, the drilling head tip is secured on the locating pin 13 in the longitudinal axial direction. In the embodiment shown, the locating pin 13 also has an angle of 5° to the longitudinal axis X-X, so that the front side of the locating pin 13 forms an angle to the area 17 of the locating pin 13 that is aligned with the longitudinal axis of the drill string.

In the position shown in FIG. 2, the angles of the bore 10 of the drilling head tip 9 and of the locating pin 13 are in congruent angular position, so the angular deviations of 5° each compensate for one another. The drilling head tip 9 is thus in an angular position that is suitable for a straight drilling path.

The rear end of the locating pin 13 is guided in an adapter 14 and is connected to it via a transverse pin 15 such that rotational, pulling, and pushing movement are prevented. The transverse pin 15 is secured by a wear sleeve 16, which in turn is positively connected at its front end, such that it cannot rotate, to the locating pin 13. The wear sleeve 16 serves as replaceable wear protection.

The adapter 14 has an elliptical bore 18 at the rear end in order to be coupled to a first drill rod, which is also elliptical. In the embodiment shown in FIG. 2, a plug connection, which is secured by means of a pin, is provided for connection to the rod section.

A transmitter 19, which transmits electromagnetic waves to a receiving device in order to be able to determine the current depth and/or the position of the drilling head 7, is mounted in the adapter 14 for above-ground depth measurement and position determination. In the area of the transmitter 19 on the adapter 14, transmitter slots 20 are formed, through which the electromagnetic waves can exit.

In FIG. 2, which depicts the first angular position for straight drilling, it is shown that the bore 10 has a stop surface or stop edge 11, on which a stop surface or stop edge 24 of the locating pin 13 rests.

Figure 3:
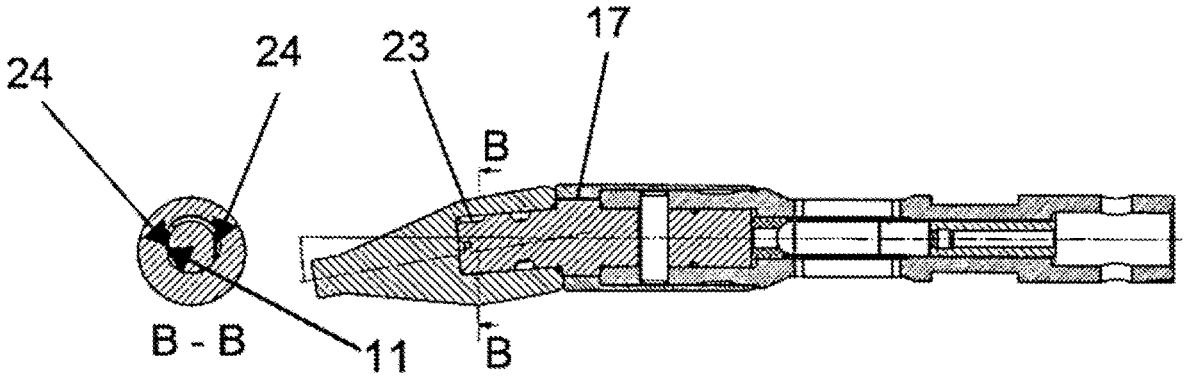
FIG. 3 the front area of the drill string with the drilling head of FIG. 2 in a second angular position.

FIG. 3 shows the drilling head 7 that is depicted in more detail in FIG. 2 in a position, or (second) angular position, that is suitable for introducing a curved path to the drilling path in order to, for example, make corrections to the drilling path and thus to reach a predefined target. The locating pin 13, which has a second stop edge 24 in a partial area 23 of its length to the first stop surface or stop edge 24, is rotated relative to the drilling head tip 9, wherein the soil holds the drilling head tip 9 in position. As a result, the second stop edge 24 of the locating pin 13 arrives at the stop edge 11 of the bore 10 of the drilling head tip 9. The entire drill string, including the drilling head tip 9, can be turned in the direction intended for course correction via the stop edges 11, 24. The angles of 5° each add up to a total of 10° for the angle of the drilling head tip 9, which is shown in FIG. 3. The angles of the bore 10 of the drilling head tip 9 and of the locating pin 13 have been brought into opposite angular positions compared to the position shown in FIG. 2.

Figure 4:
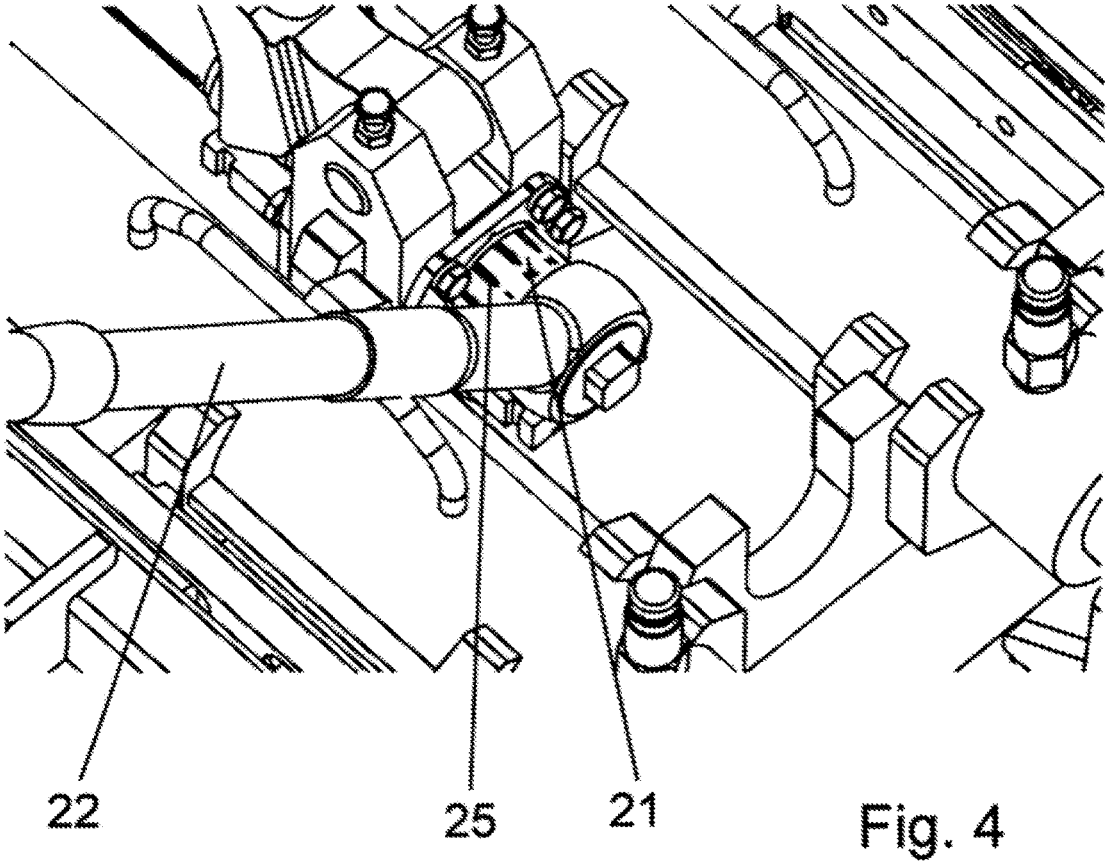
FIG. 4 an enlarged view of FIG. 1 in the area of the drive of the ground drilling device.

Rotation of the locating pin 13 is achieved by attaching a rotary adapter 21 to the rear rod section 6, which is still to be inserted, with a ratchet 22, shown enlarged in FIG. 4. By means of a clockwise rotation of 180° of the entire drill string provided in the embodiment, as well as the components connected thereto in a rotationally fixed manner, as described above, with the adapter 14, the locating pin 13, and the wear sleeve 16, the entire drill string is rotated, wherein the drilling head tip 9 is prevented from rotating by the surrounding soil.

To assist the operator with the control process or the deflection of the locating pin 13, a scale 25 in the form of the time or a roll angle is attached to the rotary adapter 21. After successfully completing the control process (i.e., a completed course correction with a corresponding run of the drill string by pushing it into the soil), the drilling head tip 9 in the illustrated embodiment can be set back to straight ahead (as shown in FIG. 2) by turning the entire drill string counterclockwise by 180°, whereby the locating pin 13 is rotated, and the drilling head tip 9 is in turn prevented from rotating by the soil.

The invention claimed is:

1. A ground drilling device comprising: a controllable drilling head comprising a drilling head tip and a locating pin that carries the drilling head tip, wherein the drilling head tip has defined therein a bore slanted to a longitudinal axis; wherein the locating pin is angled to the longitudinal axis, and wherein the drilling head tip is rotatable on the locating pin, the drilling head tip and the locating pin being arranged in a first angular position relative to one other for straight drilling, and the drilling head tip and the locating pin being arranged in a second angular position relative to one another for drilling that deviates from straight drilling; and a drive for pushing or pulling a drill string with the drilling head; wherein the drive is adapted to be positioned in an excavation pit or a shaft, wherein the locating pin comprises two locating pin stop surfaces, or the bore is delimited by two bore stop surfaces, and wherein the two locating pin stop surfaces or the two bore stop surfaces are spaced apart from one another in the longitudinal direction of the drilling head tip or the locating pin, and the two locating pin stop surfaces or the two bore stop surfaces form end positions of a relative rotational movement of the locating pin in the bore, and wherein the ground drilling device further comprises a scale positioned in an area of the drive, by means of which a degree of rotation of the two locating pin stop surfaces or the two bore stop surfaces about the longitudinal axis of the locating pin or the bore is displayed.

2. A method for controlling a drilling head of a ground drilling device, the drilling head on a drill string for ground drilling, the drilling head having a drilling head tip and a locating pin that carries the drilling head tip, the drilling head tip having a bore slanted to a longitudinal axis and the locating pin being angled to the longitudinal axis, the method comprising: rotating the drilling head tip relative to the locating pin to bring into a first angular position for straight drilling; and bringing the drilling head tip and the locating pin into a second angular position relative to one another for drilling that deviates from straight drilling, wherein the locating pin comprises two locating pin stop surfaces, or the bore is delimited by two bore stop surfaces, and wherein the two locating pin stop surfaces or the two bore stop surfaces are spaced apart from one another in the longitudinal direction of the drilling head tip or the locating pin, and the two locating pin stop surfaces or the two bore stop surfaces form end positions of a relative rotational movement of the locating pin in the bore, and wherein the ground drilling device comprises a scale positioned in an area of the drive, by means of which a degree of rotation of the two locating pin stop surfaces or the two bore stop surfaces about the longitudinal axis of the locating pin or the bore is displayed.

3. The ground drilling device according to claim 1, wherein the bore forms a 5° angle with respect to the longitudinal axis and/or a bend of the locating pin forms a 5° angle with respect to a longitudinal axis of the locating pin.

4. The ground drilling device according to claim 1, wherein the drilling head tip comprises a diameter of less than 70 mm.

5. The ground drilling device according to claim 1, wherein the locating pin is at least partially surrounded by a wear sleeve.

6. The ground drilling device according to claim 1, wherein the two locating pin stop surfaces or the two bore stop surfaces form an angle of greater than 45° to one another.

* * * * *